US006427258B1

(12) United States Patent
Gooley

(10) Patent No.: US 6,427,258 B1
(45) Date of Patent: Aug. 6, 2002

(54) APPARATUS AND METHOD FOR EXTENDING AN OBJECT

(75) Inventor: James C. Gooley, Wayzata, MN (US)

(73) Assignee: Wayzata Innovative Technologies, Wayzata, MN (US)

( * ) Notice: Subject to any disclaimer, the term of this patent is extended or adjusted under 35 U.S.C. 154(b) by 0 days.

(21) Appl. No.: 09/342,288

(22) Filed: Jun. 29, 1999

Related U.S. Application Data

(60) Provisional application No. 60/091,024, filed on Jun. 29, 1998.

(51) Int. Cl.[7] ..... A47K 3/02

(52) U.S. Cl. ..... 4/566.1; 4/564.1; 4/559; 4/562.1; 4/563.1

(58) Field of Search ..... 4/566.1, 564.1, 4/557, 541.1, 246.2, 495, 496, 560.1, 565.1, 562.1, 563.1; 254/93 R, 89 H, 93 L

(56) References Cited

U.S. PATENT DOCUMENTS

| | | | | |
|---|---|---|---|---|
| 48,888 A | | 7/1865 | Atwater | |
| 742,118 A | | 10/1903 | Huddleston | |
| 1,683,430 A | * | 9/1928 | Wright | 4/566.1 |
| 2,171,084 A | | 8/1939 | Fasce | |
| 2,253,475 A | | 8/1941 | Willber | |
| 2,875,012 A | | 2/1959 | Riley | |
| 4,557,002 A | | 12/1985 | Schmidt | |
| 4,598,432 A | | 7/1986 | Pennington-Richards | |
| 4,624,019 A | | 11/1986 | Pennington-Richards | |
| 4,714,305 A | | 12/1987 | Service | |
| 4,740,044 A | | 4/1988 | Taylor | |
| 4,905,327 A | | 3/1990 | Boublil | |
| 4,981,085 A | | 1/1991 | Watt | |
| 5,007,121 A | | 4/1991 | McEathron | |
| 5,129,112 A | | 7/1992 | Schaffer | |
| 5,129,611 A | | 7/1992 | Grover et al. | |
| 5,157,797 A | * | 10/1992 | Forwick | 4/566.1 |
| 5,203,619 A | | 4/1993 | Welsch et al. | |
| 5,279,004 A | | 1/1994 | Walker | |
| 5,377,366 A | | 1/1995 | Boyd et al. | |
| 5,718,007 A | * | 2/1998 | Loyd | 4/546 |
| 5,876,095 A | | 3/1999 | Johnston | |

FOREIGN PATENT DOCUMENTS

| | | | | |
|---|---|---|---|---|
| GB | 2123285 | * | 2/1984 | 4/563.1 |
| JP | 4-285512 | | 10/1992 | 4/546 |

* cited by examiner

*Primary Examiner*—David J. Walczak
(74) *Attorney, Agent, or Firm*—Skinner and Associates

(57) ABSTRACT

A device, comprising an extendable object having a retracted position and an extended position with respect to a fixture; and a motive power system adapted for moving the object between the retracted and extended positions. The extendable object is preferably a water fixture amenity, such as a concealable compartment or a raisable seat. Preferably, the motive power system is a hydraulic system and includes a cylinder, a power source, and controls. The cylinder has a piston adapted for moving the compartment with respect to the fixture. The power source is connected to the cylinder and is adapted to extend the piston and move the compartment. The power source includes a water line in fluid communication with a cylinder volume. The controls are adapted for regulating movement of the piston by the power source. A method of moving a water fixture amenity, including the concealable compartment and the raisable seat, generally comprises two steps. The first step is opening a fluid communication channel between a fluid source and a cylinder volume to extend a cylinder piston and move an amenity. The second step is closing the fluid communication channel between the fluid source and the cylinder volume, and opening a fluid communication channel between the cylinder volume and a fluid drain to allow the cylinder piston to retract.

2 Claims, 9 Drawing Sheets

APPARATUS AND METHOD FOR EXTENDING AN OBJECT

This application claims priority of provisional application 60/091,024 filed Jun. 29, 1998.

BACKGROUND OF THE INVENTION

1. Field of the Invention

The present invention relates, generally, to methods and apparatus for extending objects. More particularly, the invention relates to extendable water fixture amenities powered by water line pressure. The invention has particular utility either as a concealable compartment or shelf, or as a raisable seat adapted for assisting a person into and out of a tub or other water fixture.

2. Background Information

Water fixtures include sinks, showers, bathtubs, hot tubs, washing machines, dishwashers and other appliances or devices that are connected to water line or source, and, for the purposes of this specification, cabinets, countertops and other associated structures. Water fixture amenities are attractive, valuable features of the water fixture that promotes comfort, convenience or enjoyment. Movement is a desirable characteristic for water fixture amenities. For example, it is desirable to move a storage compartment between positions of non-interference and accessibility for aesthetic or functional reasons. It is also desirable to assist people into and out of a bathtub because many people have difficulty sitting down and standing back up again in a slippery bathtub. Extendable water amenities include, inter alia, concealable compartments, drawers or shelving, and raisable seats or bathtub chairs adapted for assisting a person into and out of a tub. Preferably, these amenities are built into the fixtures and, as an attractive or valuable feature that promotes comfort and enjoyment of the fixture, extend and retract in quiet, smooth and reliable movements.

The state of the art generally includes various methods and apparatus for extending objects. Known concealable compartments use electrical motors or manual pull and pulley systems to conceal and reveal storage compartments within walls and desks. Known bathtub chairs are raised using manual powered mechanisms, electric motors, and bladders and cylinders.

These devices and methods are believed to have significant limitations and shortcomings. Specifically, many apparatus for extending objects are not automated. Additionally, if the apparatus is automated, electric motors and compressors are noisy, present an electrical shock hazard and corrode around showers, tubs, sinks, and other water fixtures. Further, these electric motors and compressors may generate an excessive amount of force that could pinch and injure users.

This invention provides water fixture amenities, including concealable compartments and raisable seats, which are believed to constitute an improvement over existing technology.

BRIEF SUMMARY OF THE INVENTION

The present invention provides a method and apparatus for extending water fixture amenities. The apparatus generally comprises an extendable object having at least a retracted position and an extended position with respect to a water fixture, and a motive power system adapted for moving the object with respect to the fixture. For the purposes of this specification, the term water fixture is defined broadly and includes sinks, showers, bathtubs, hot tubs, washing machines, dishwashers and other appliances or devices that are connected to a water line or source. Additionally, the term water fixture is intended to cover cabinets, countertops and other associated structures. Amenities are generally defined as attractive, valuable features of a structure that promote comfort, convenience or enjoyment. Extendable water amenities include, inter alia, concealable compartments, drawers or shelving, and raisable seats adapted for adapted for assisting a person into and out of a tub.

The concealable compartment embodiment of the present invention includes a compartment having at least a retracted position and an extended position with respect to the water fixture. The compartment is accessible in the extended position and concealed in the retracted position. A surface plate of the compartment is flush with an exterior surface of the fixture when the compartment is in the retracted position. The motive power system is adapted for moving the compartment with respect to the fixture. Preferably, the motive power system is a hydraulic system, including a cylinder, a power source, and controls. The cylinder has a piston adapted for moving the compartment with respect to the fixture. The power source, preferably a water line, is connected to the cylinder and is adapted for extending the piston and moving the compartment. The controls are adapted for regulating movement of the piston by the power source, and generally include a valve mechanism and an actuator. The valve mechanism is adapted for governing fluid communication between the water line and the cylinder volume, and the actuator is adapted for influencing the valve mechanism.

The raisable seat embodiment operates similar to the concealable compartment. A seat or chair is operably connected to the cylinder. The cylinder raises and lowers the seat which assists the person between a seated position and a standing position. A preferred raisable seat embodiment uses multiple cylinders to lift an adult because of the weight of the adult with respect to the available water line pressure. Additionally, a preferred raisable seat embodiment swivels to allow a user to sit down on the seat from a standing position outside of the tub, swivel over the tub, and be lowered into the tub.

The method of moving a water fixture amenity, including the concealable compartment and the raisable seat, generally comprises two steps. The first step is opening a fluid communication channel between a fluid source and a cylinder volume to extend a cylinder piston and move an amenity. The second step is closing the fluid communication channel between the fluid source and the cylinder volume, and opening a fluid communication channel between the cylinder volume and a fluid drain to allow the cylinder piston to retract.

The features, benefits and objects of this invention will become clear to those skilled in the art by reference to the following description, claims and drawings.

DETAILED DESCRIPTION

Figure 2:
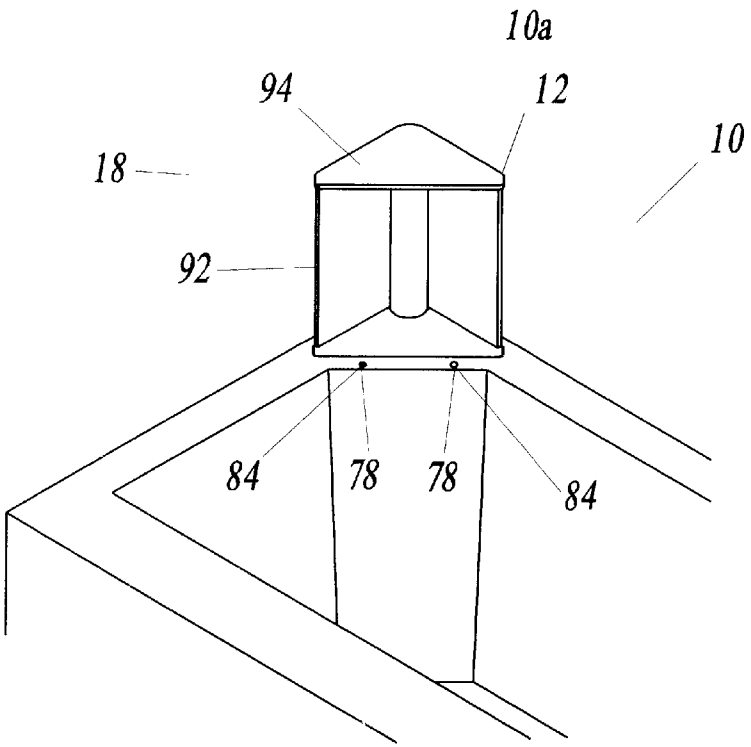
FIG. 2 is a perspective view of an extended, accessible compartment amenity for a bathtub.
Figure 1:
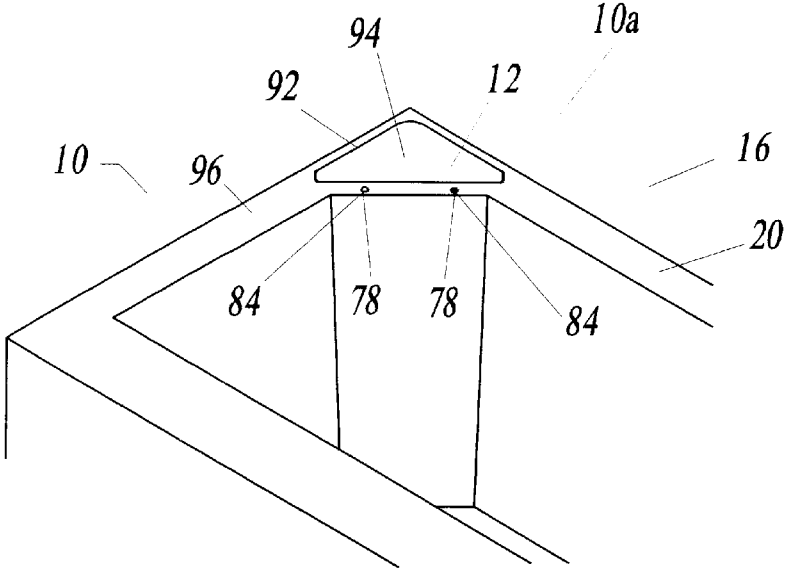
FIG. 1 is a perspective view of a retracted, concealed compartment amenity for a bathtub.

Referring to FIGS. 1–18, examples of preferred embodiments of the present invention are illustrated and generally indicated by the reference numeral 10. The apparatus or device for extending objects, or the extension device 10, is described below first in terms of its major structural elements and then in terms of its secondary structural and/or functional elements which cooperate to extend an object with respect to a fixture. FIGS. 1–5, 10 and 17 illustrate a concealable compartment embodiment of the extension device 10*a* and FIGS. 11–14 illustrate a raisable seat embodiment 10*b* of the extension device 10.

The extension device 10 generally comprises an extendable object 12 and a motive power system 14. As shown in FIGS. 1–4, 6–7 and 11–14, the object 12 is movable between a retracted position 16 and an extended position 18 with respect to a fixture 20, and may have multiple distinct positions between the retracted position 16 and extended position 18. The motive power system 14 is adapted for moving the object 12 between these two positions 16 and 18.

Figure 6:
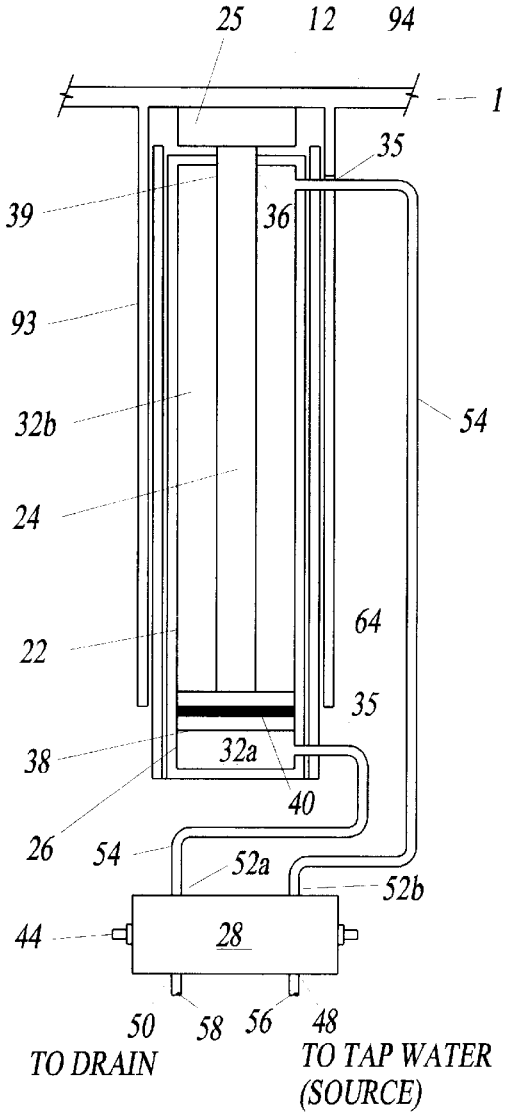
FIG. 6 is a view illustrating the valve, piston and extendable object in a retracted position.
Figure 7:
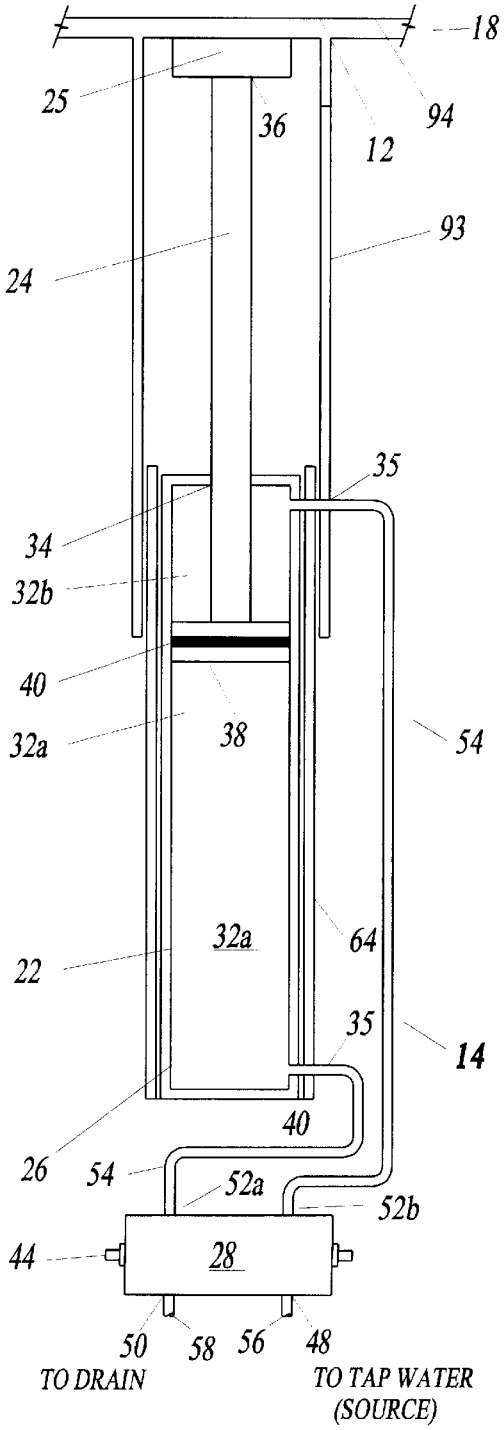
FIG. 7 is a view illustrating the valve, piston and extendable object in an extended position.
Figure 8:
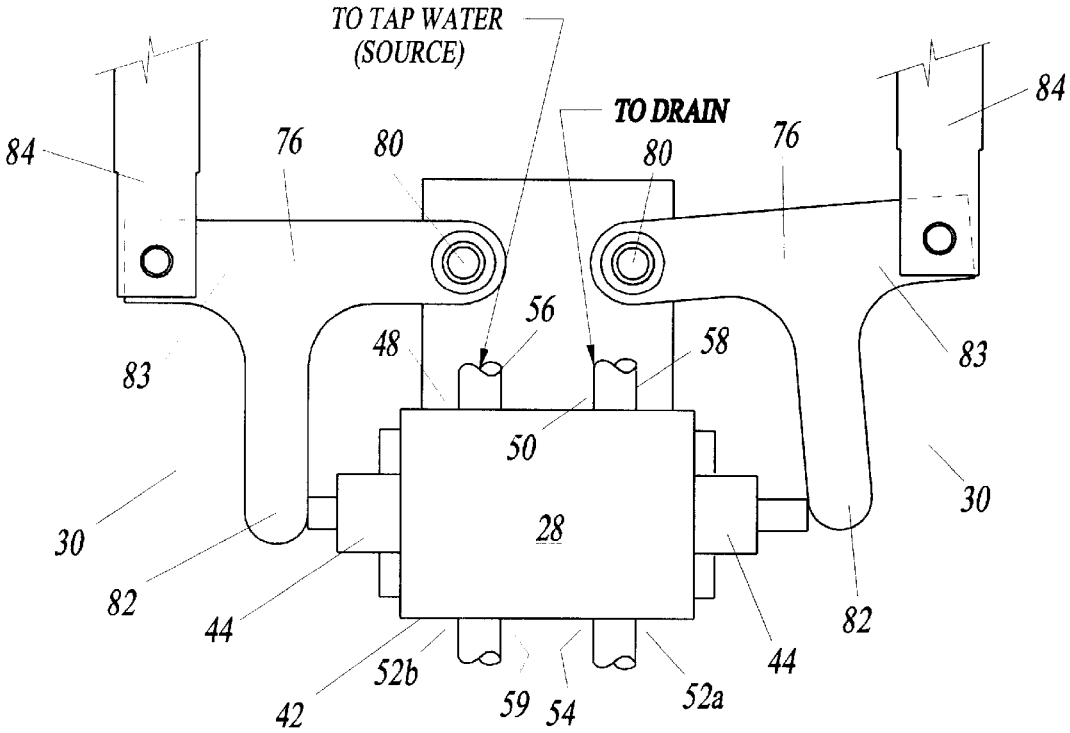
FIG. 8 is a plan view illustrating a valve block.
Figure 9:
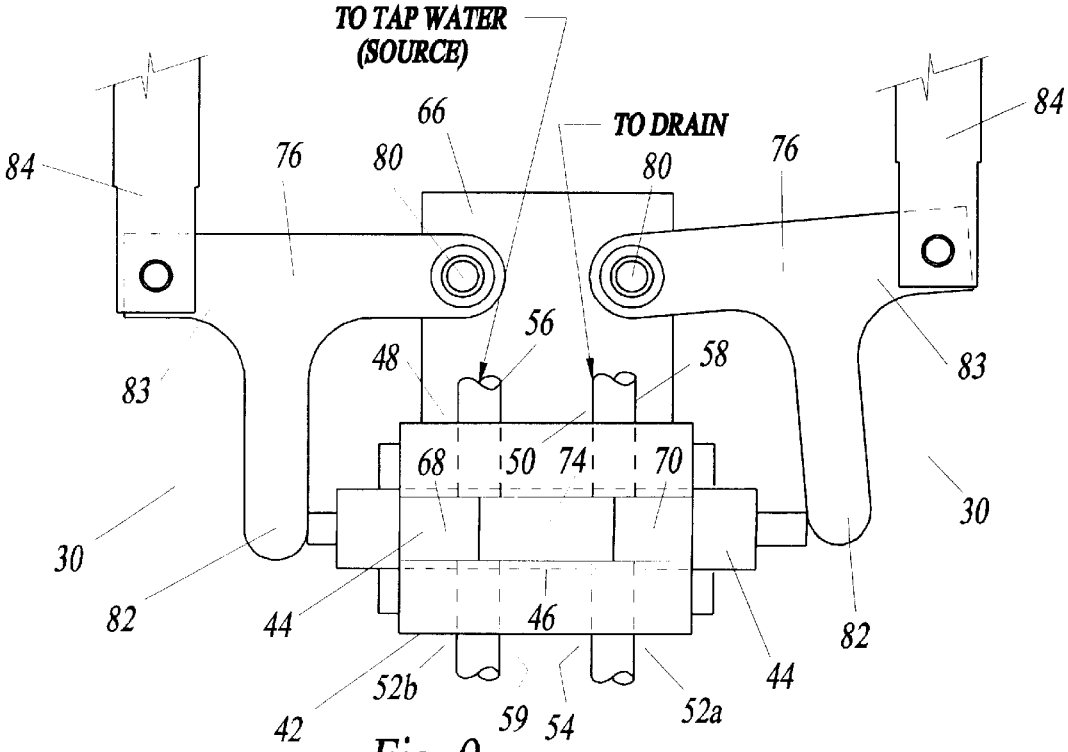
FIG. 9 is a plan view, partially in cross section, of the valve block of FIG. 8.

The extendable object 12 is preferably an amenity for a fixture. The motive power system 14 may include mechanical, electrical, pneumatic or hydraulic mechanisms. Referring specifically to FIGS. 6–9 and FIGS. 15–18, a preferred embodiment of the motive power system 14 generally comprises a cylinder 22, a power source, and controls. As shown in FIGS. 6 and 7, the cylinder 22 has a piston 24 slidably received within a housing 26, and is positioned, arranged and otherwise adapted for moving the object 12 with respect to the fixture 20. The power source is preferably a source of pressurized fluid, such as air or liquid, which is in fluid communication with the cylinder 22. Referring to FIGS. 8 and 9, the controls are generally adapted for regulating the movement of the piston 24 by the power source. The controls generally include a valve mechanism 28 and at least one actuator 30. The valve mechanism 28 is adapted for governing fluid communication between the fluid power source and the cylinder 22. The actuator 30 is adapted for influencing the valve mechanism 28 for the purpose of regulating the movement of the piston 24.

When the extension device 10 forms a water fixture amenity, the motive power system 14 is preferably a hydraulic system connected to the water line, or tap water, for the water fixture. The water line pressure provides sufficient force to extend the object. The flow of the water into a hydraulic cylinder 22 provides a number of benefits, including reliable, smooth and quiet motion of the extendable object 12. Additionally, the hydraulic cylinder 22 uses a minimal amount of water to move the object 12 a desired distance. For example, the total amount of water used to extend and retract the piston 24 for the cylinder 22 illustrated in the figures is less than a cup.

In addition to the piston 24 and housing 26, the cylinder 22 generally has a variable volume chamber or first volume 32*a* and may further include wipers or seals 34 to prevent contaminants from entering the cylinder 22 and a stem or nipple 35 to provide fluid communication from the first volume 32*a* through the housing 26. The piston 24 has an end 36, preferably threaded, upon which a cap 25 is screwed. The cap 25 is in operable contact with the object 12. The piston 24 further has a head 38 positioned to define the first volume 32*a* within the cylinder 22. The head 38 has an o-ring washer 40 to promote a sealing fit. A second volume 32*b* may be formed within the cylinder 22 on the opposing side of the piston head 38. The second volume 32*b* provides a positive force for retracting the piston 24 into the housing 26.

Thus, regardless of whether the piston 24 is oriented vertically, horizontally, or in another direction, the piston 24 can be reliably, smoothly and quietly retracted by directing fluid through a nipple 35 and into the second volume 32*b* while draining fluid from the first volume 32*a*.

As an alternative to using the second volume 32*b* and hydraulic pressure to retract the piston 24, gravity or a mechanical spring force may be used to bias the piston 24 in the retracted position. For example, in a vertical arrangement, the weight of the object 12 may be used to pressurize and expel the fluid from the cylinder volume 32*a*. In a horizontal arrangement, an object such as a drawer could be biased in a retracted position using mechanical springs, which may be used to pressurize and expel the fluid from the cylinder volume 32*a*.

As illustrated in FIGS. 8 and 9, the valve mechanism 28 includes a valve block 42 and a valve rod 44. The valve block 42 is preferably constructed as a unitary structure having a valve channel 46, at least one inlet port 48, at least one release port 50, and at least one cylinder port 52*a,b*, all of which are in fluid communication with each other depending on the position of the valve rod 44. The valve rod 44 has a moveable and sealable fit within the valve channel 46. The valve rod 44 has a first or ON position, wherein the valve rod 44 slides in one direction, and a second or OFF position, wherein the valve rod 44 slides in the other direction. The valve rod 44 further has a predetermined configuration for providing the desired fluid communication between the ports 48, 50, 52*a* and 52*b* based on position. The fluid source, a water line in the preferred embodiment, is in fluid communication with the first volume 32*a* of the cylinder 22 through the inlet port 48, the valve channel 46 and the cylinder port 52*a* when the valve rod 44 is in the first position. Similarly, the cylinder 22 is in fluid communication with a fluid drain through the cylinder port 52*b*, the valve channel 46 and the release port 50 when the valve rod 44 is in the second position. The actuator 30 is adapted for influencing the valve rod 44 into either the first position or the second position. A cylinder hose 54 provides fluid communication between the cylinder ports 52*a* and 52*b* and the volumes 32*a* and 32*b* of the cylinder 22, an inlet hose 56 provides fluid communication between a pressurized water line or fluid source and the inlet port 48, and a release hose 58 provides fluid communication between the release port 50 and the fluid drain.

A valve rod 44 has a first sealing head 68 and a second sealing head 70. Each sealing head 68 and 70 has washers to provide a seal with the interior of the valve channel 46. The valve rod 44 has a neck 74 of a predetermined shape or configuration. The neck 74 is formed to permit, depending on whether the valve rod 44 is in the ON or OFF position, water to flow from the inlet port 48 through the valve channel 46 and out one of the cylinder ports 52*a* and 52*b*, or water to flow from the other one of the cylinder ports 52*b* and 52*a* through the valve channel 46 and out the release port 50.

The actuator 30 provides a means to influence or move the valve rod 44 between the ON position that allows pressurized water to extend the object 12 by directing fluid from the inlet port 48 into the first volume 32*a* and fluid from the second volume 32*b* through the release port 50, and the OFF position that directs fluid into the second volume 32*b* and drains fluid from the first volume 32*a* and through the release port 50. A variety of known faucet-like systems can be used to provide the valve means described above. In the embodiment shown in the figures, the actuator 30 includes a pivot member 76 and an actuating mechanism 78. The illustrated pivot member 76 has a pivot portion 80 attached to a frame, a finger portion 82, and a lever portion 83. The finger portion 82 is adjacent to an end of the valve rod 44. The actuation mechanism 78, illustrated in the figures as rods 84, pivots the pivot member 76 enabling one of the fingers 82 to push the valve rod 44 either to the OFF position or to the ON position.

Figure 10:
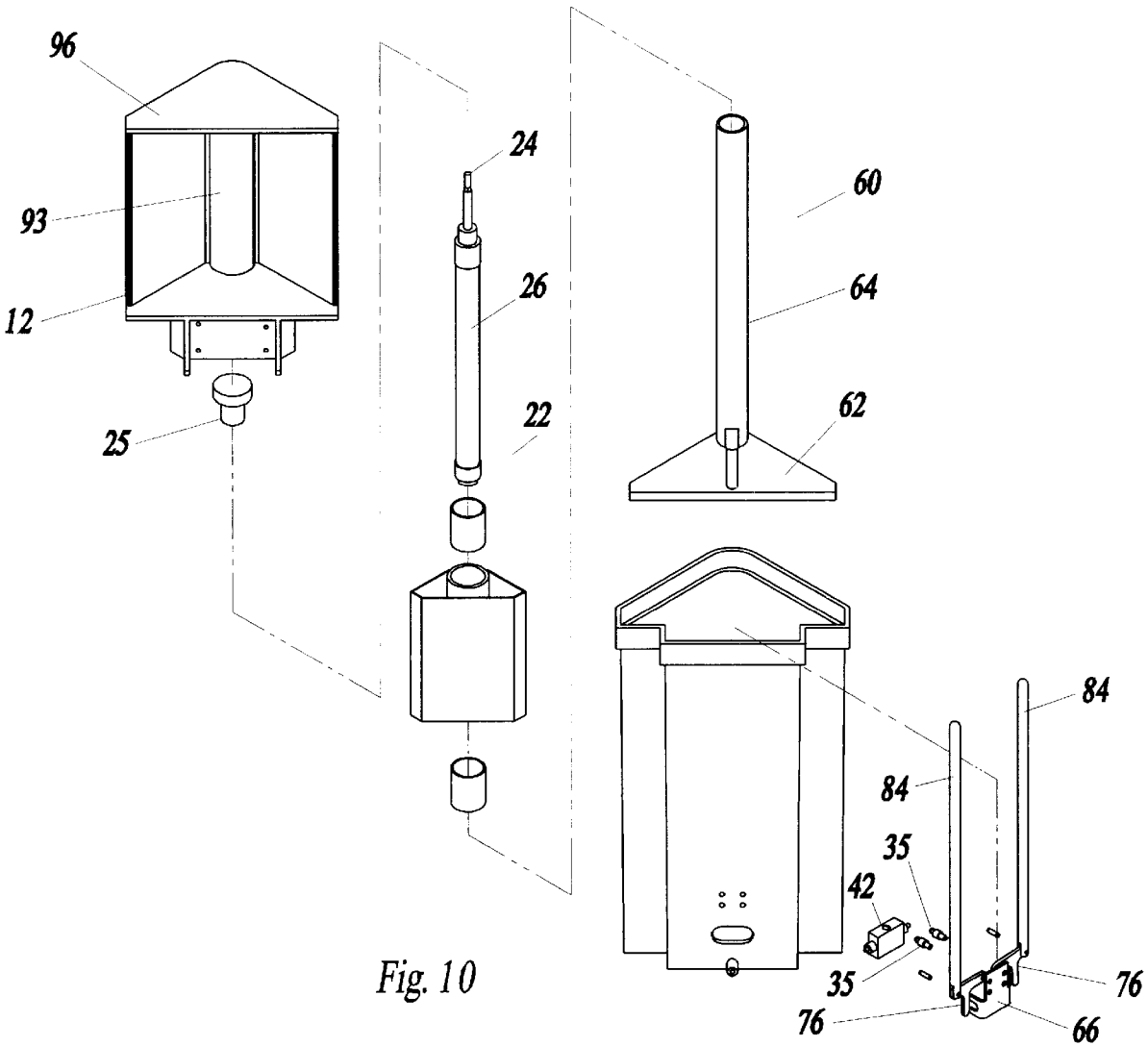
FIG. 10 is an exploded view of the concealable compartment shown in FIGS. 1–4.

Referring to FIGS. 6, 7 and 10, the object 12 preferably has a receiving portion 93, which is illustrated as having a cylindrical shape. A stand 60, having a base 62 and a support portion 64, is used to support and guide the object 12 as it travels between the retracted position 16 and extended position 18. The support portion 64 is also illustrated as having a cylindrical shape. The receiving portion 93 is adapted to receive the support portion 64 and, in the vertical arrangement generally shown in the figures, rest over the support portion 64 of the stand 60. This arrangement limits the amount of pinching force between the object 12 and the fixture 20 to the weight of the object 12. The cylinder 22 is positioned within the support portion 64 of the stand 60. The piston 24 extends out of the stand to raise the object 12.

Figure 3:
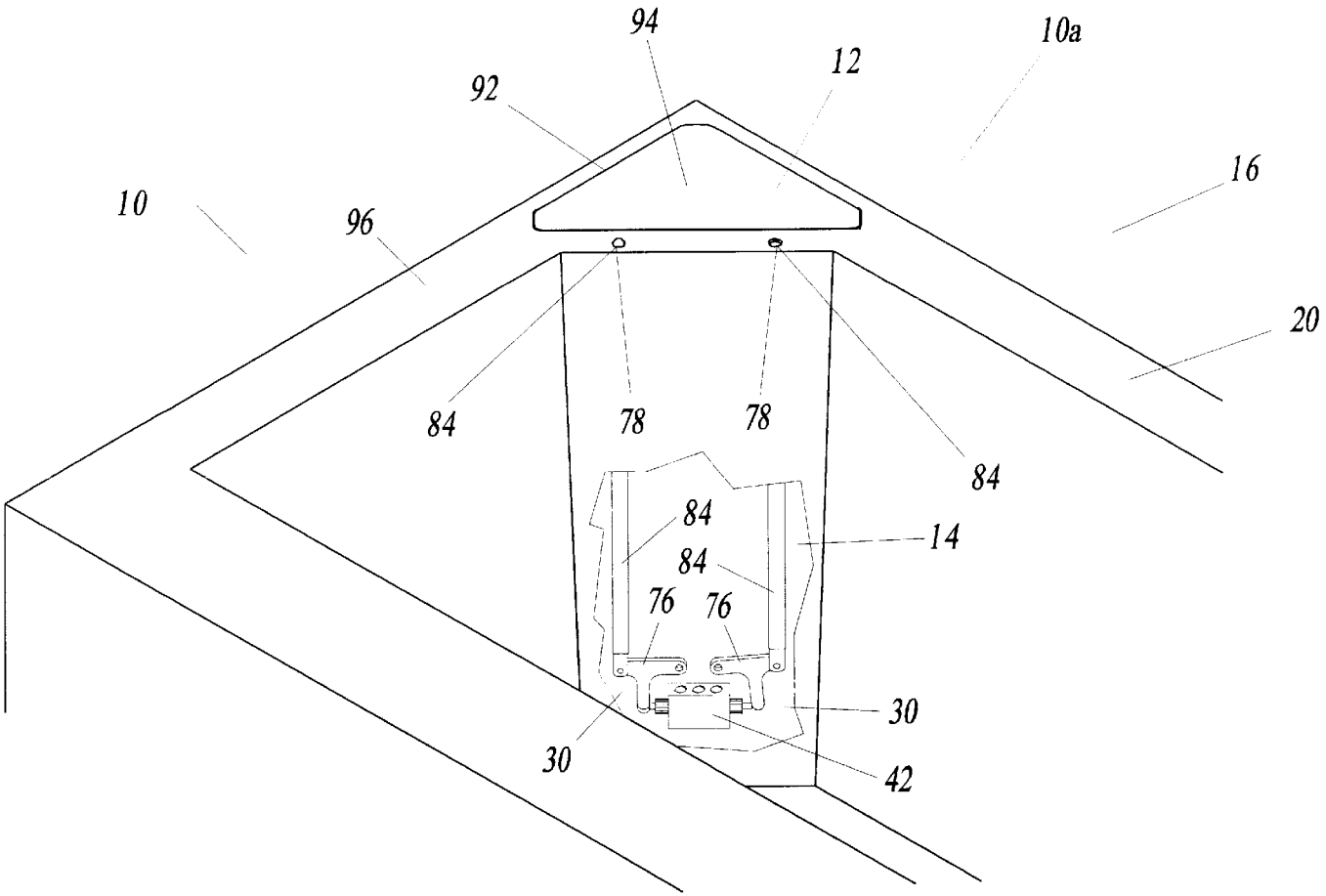
FIG. 3 is a perspective view, partially in cross section to show the valve mechanism used in the present invention, of the compartment of FIG. 1.
Figure 4:
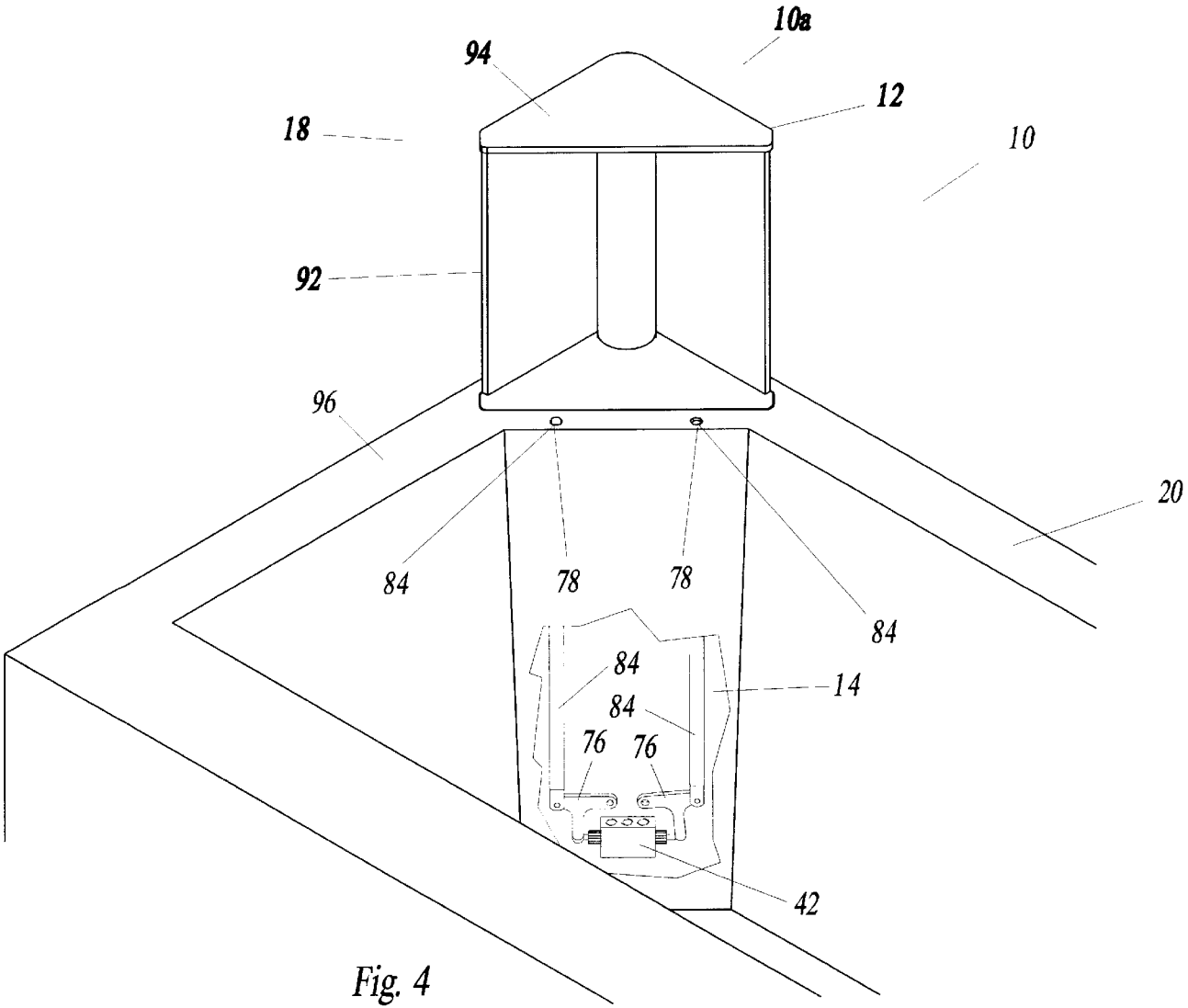
FIG. 4 is a perspective view, partially in cross section to show the valve mechanism used in the present invention, of the compartment of FIG. 2.
Figure 5:
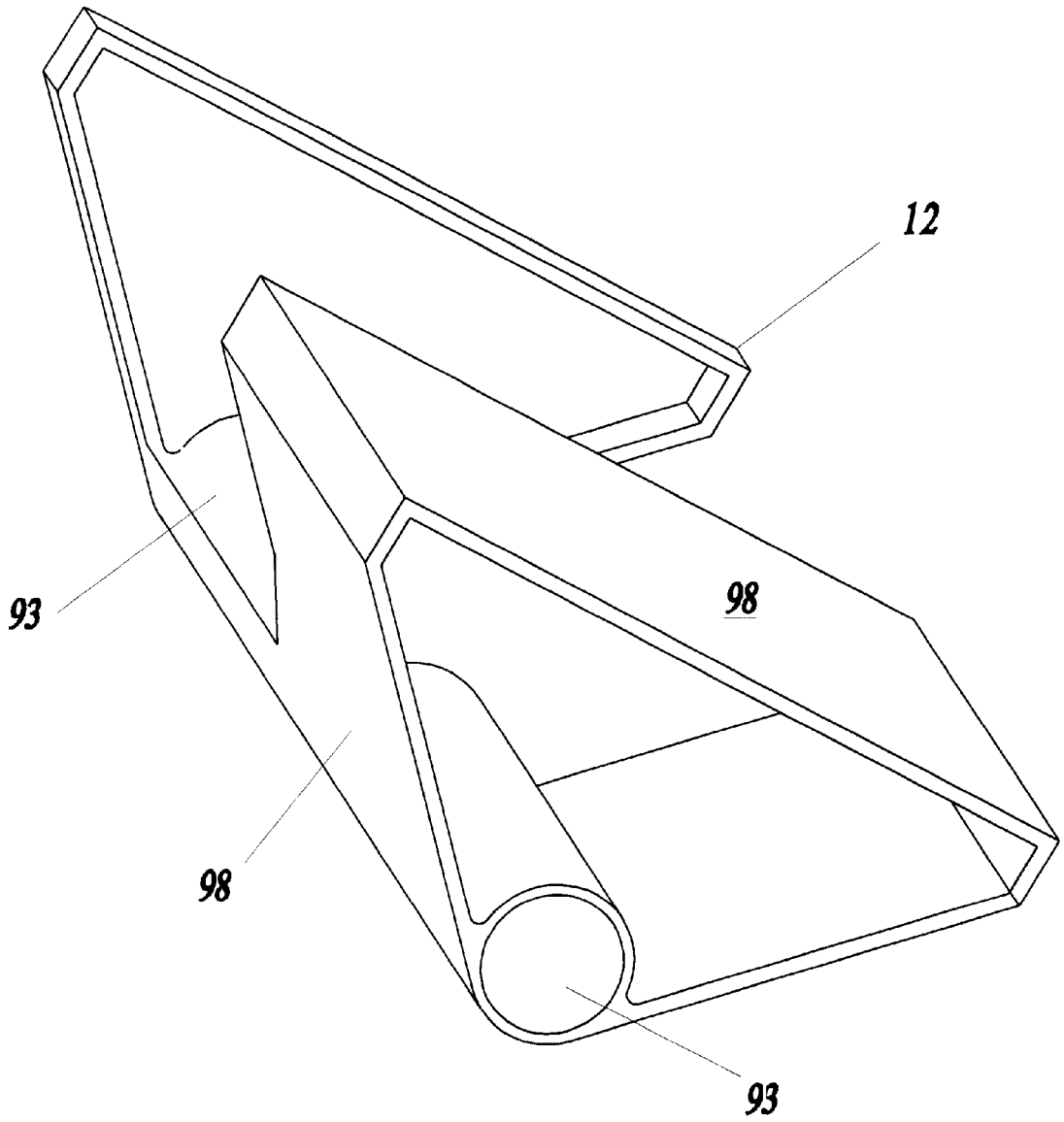
FIG. 5 is a perspective view of the bottom of the concealable compartment.

FIGS. 1–5 and 10 illustrate a concealable compartment embodiment wherein the extendable object 12 is a compartment 92 and is incorporated as a vertical drawer in a tub. The compartment 92 is typically constructed of a material similar to that of the fixture 20, but may be constructed from a variety of materials and in a variety of shapes. Preferably, the materials used in construction resist corrosion if exposed to moisture. The compartment 92 is movable between a concealed or retracted position 16 shown in FIG. 1 and a revealed, extended or accessible position 18 shown in FIG. 2. The compartment 92 has a top surface plate 94 that is preferably flush with a top surface 96 of the fixture 20 when the compartment 92 is in the retracted position 16. As illustrated in FIGS. 3–4, the two independent pivot members 76 are operably linked to the rods 84. The compartment 92 is formed with a receiving portion 93, and is supported and guided by the support portion 64 of the stand 60. Referring to FIG. 10, the stand 60 may be housed in a frame 66 which is positioned in the hollow beneath a corner of a tub. Alternatively, rather than being guided and supported by a stand 60, the compartment 92 may have an exterior surface 98 that has a cooperative shape with respect to the shape of channel walls within the fixture 20. The cooperative shapes of the exterior surface 98 and the channel walls within the fixture 20 provide a stable means for guiding and supporting the compartment as it is extended. Further, the concealable compartment embodiment preferably includes one or more gaskets, not shown, positioned between the compartment and the fixture for the purpose of preventing water from seeping between the fixture and the compartment for any compartment position between and including the retracted and extended positions. A drain port in combination with a collection plate, neither of which are shown, may be incorporated into the design to remove water or condensation that may collect either beneath or in the fixture 20. The drain port is connected to the main water drain for the fixture 20.

Figure 12:
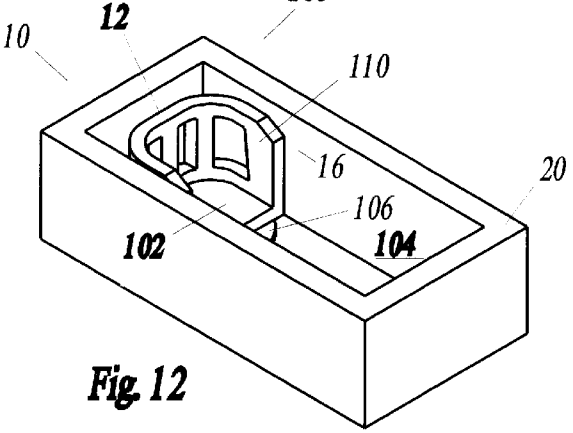
FIG. 12 is a perspective view of an extended raisable seat amenity in a second swivel position.
Figure 14:
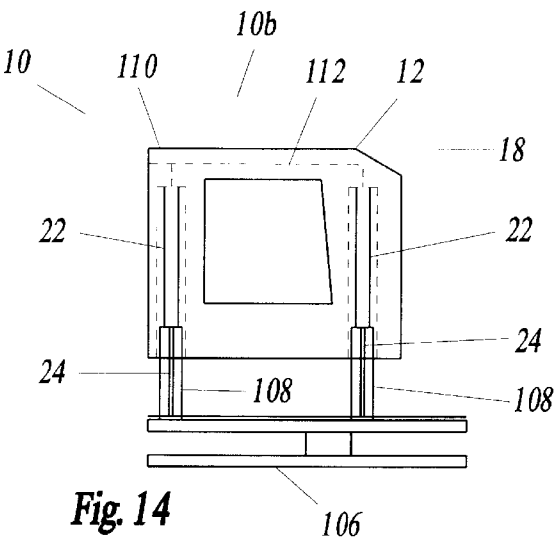
FIG. 14 is a side view, partially in cross section, of the raisable seat amenity of FIG. 12.
Figure 11:
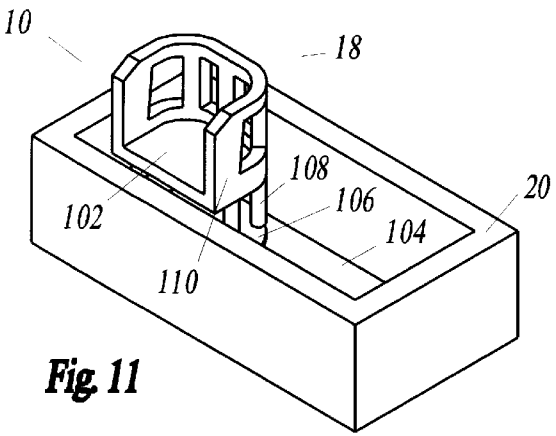
FIG. 11 is a perspective view of an extended raisable seat amenity in a first swivel position.
Figure 13:
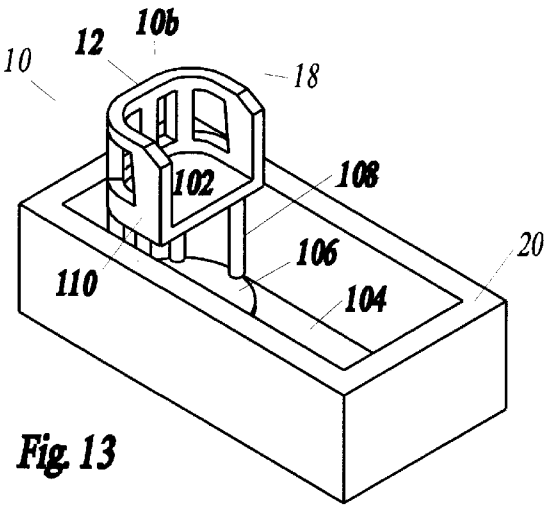
FIG. 13 is a perspective view of a retracted raisable seat amenity.
Figure 15:
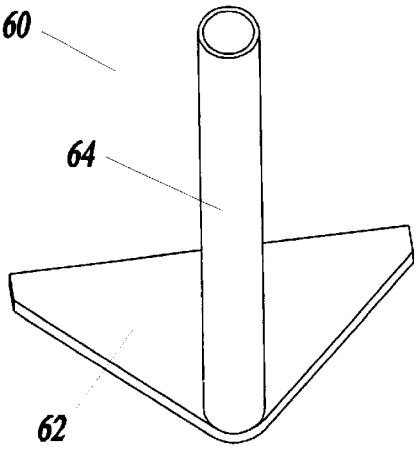
FIG. 15 is a perspective view of a stand adapted for supporting and guiding the extendable object.
Figure 16:
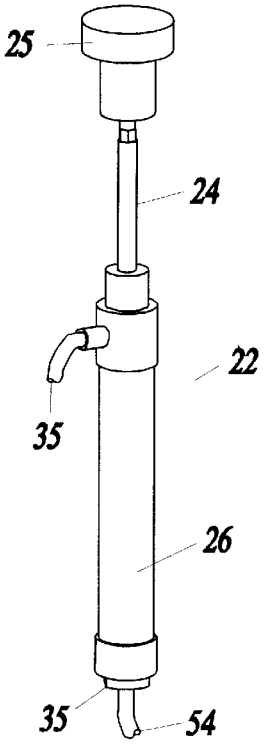
FIG. 16 is a plan view of a cylinder.
Figure 17:
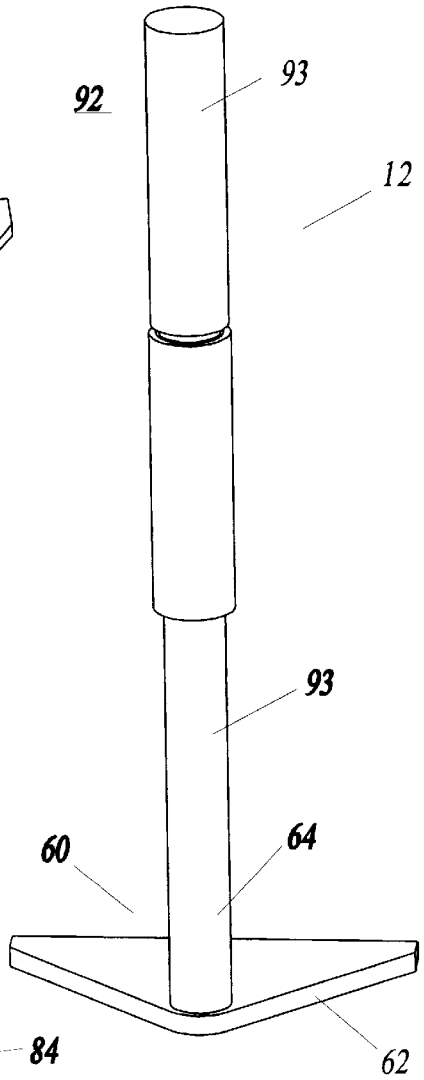
FIG. 17 is a plan view of a compartment inserted over the stand.
Figure 18:
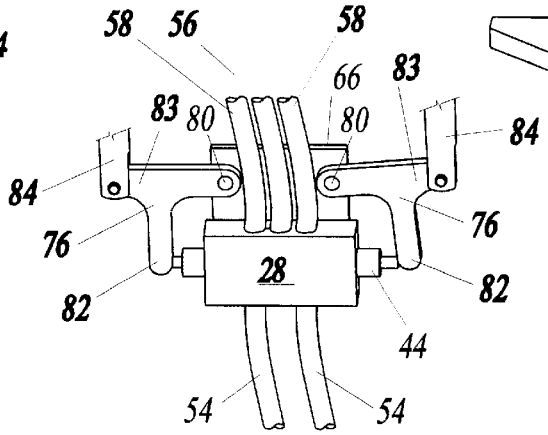
FIG. 18 is a plan view illustrating a valve mechanism.

FIGS. 11–14 illustrate a raisable seat embodiment in which the extension device 10 is built on or into a floor 104 of a tub and the extendable object 12 is a chair or seat 102. A user sits in the seat 102 when it is in an extended position and in a first swivel position as shown in FIG. 11. The user then swivels over the tub or fixture 12 as shown in FIG. 12, and lowers the seat 102 into the tub. As shown in FIG. 14, the extension device 10 includes a swivable platform 106, extendable legs 108, the seat 102, and a back 110. The back 110 includes hollow portion in which the extendable legs 108 can retract into the back 110 when the seat 102 is in the retracted position. The extendable legs 108, in effect, function similarly to the support portion 64 of the stand 60 in that it supports and guides the chair as it extends. A cylinder 22 is oriented inside of each leg so that the piston 24 extends up into the hollow portion of the back 110. Channels 112 for fluid communication with each cylinder 22 and controls may be designed into the platform 106 using, for example, a rotatable fluid coupling (not shown) in the floor 104. Multiple cylinders 22 may be required and desired to lift and stabilize a user because of the weight of the user with respect to the pressure of the tap water. The figures generally illustrate the functionality of the raisable seat embodiment. Modifications to the design are anticipated. One such modification is to form the seat 102 and back 110 with numerous holes for the purpose of reducing the amount of displaced water when the seat 102 is lowered without sacrificing the comfort or structural integrity of the seat 102 and back 110.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A device for use with a fixture having an exterior surface, comprising:

(a) an extendable compartment having a retracted position and an extended position with respect to the fixture, said compartment having a surface plate, and said compartment being accessible in said extended position, said surface plate being flush with the fixture exterior surface when said compartment is in said retracted position; and (b) a motive power system for moving said compartment between said retracted position and said extended position, said motive power system including (i) a cylinder with a piston movably disposed in said cylinder and being communicatively connected to said compartment, said cylinder and said piston defining a first volume on a first side of said piston and a second volume on a second side of said piston, (ii) a fluid power source communicatively connectable to said cylinder for extending and retracting said piston; and (iii) a selectively actuatable valve mechanism for regulating extension and retraction of said piston by governing fluid communication between said fluid power source and said first and second volumes of said cylinder, whereby said compartment is extended by actuating said valve mechanism to provide fluid communication between said fluid power source and said first cylinder volume, and whereby said compartment is retracted by actuating said valve mechanism to provide fluid communication between said fluid power source and said second cylinder volume.

2. A concealable compartment forming an amenity for a water fixture, comprising:

(a) a compartment having at least a retracted position and an extended position with respect to a water fixture, said compartment having a surface plate and said fixture having an exterior surface, said compartment being accessible in said extended position, said surface plate being flush with said exterior surface of said fixture when said compartment is in said retracted position; and (b) a motive power system adapted for moving said compartment between said retracted position and said extended position, said motive power system being a hydraulic system, said motive power system including:

(i) a cylinder having a piston and first and second cylinder volumes adapted for extending and retracting said compartment with respect to said fixture;

(ii) a power source connected to said cylinder and adapted to extend and retract said piston and move said compartment, said power source including a water line in fluid communication with said cylinder volume; and (iii) controls adapted for regulating movement of said piston by said power source, said controls including a valve mechanism and an actuator, said valve mechanism being adapted for governing fluid communication between said water line and said first and second cylinder volumes, said actuator being adapted for influencing said valve mechanism, whereby establishing fluid communication between said water line and said first cylinder volume extends said compartment and establishing fluid communication between said water line and said second cylinder volume retracts said compartment.

* * * * *